United States Patent [19]

Wang

[11] 4,248,063

[45] Feb. 3, 1981

[54] MANUAL KNITTING APPARATUS

[76] Inventor: Kai Wang, 233 Sundown Trail, Williamsville, N.Y. 14221

[21] Appl. No.: 26,901

[22] Filed: Apr. 4, 1979

[51] Int. Cl.[3] ..... B04B 3/00
[52] U.S. Cl. ..... 66/4
[58] Field of Search ..... 66/1–4

[56] References Cited

U.S. PATENT DOCUMENTS

| | | | |
|---|---|---|---|
| 2,072,668 | 3/1937 | Eltgroth | 66/4 |
| 2,237,733 | 4/1941 | Grimm et al. | 66/4 |
| 2,270,619 | 1/1942 | Bowyer | 66/4 |
| 2,450,067 | 9/1948 | Wolff | 66/4 |
| 3,533,891 | 10/1970 | Corey | 66/1 A |
| 3,967,467 | 7/1976 | Leach | 66/4 |
| 4,158,296 | 6/1979 | Dunlop | 66/4 |

FOREIGN PATENT DOCUMENTS

| | | | |
|---|---|---|---|
| 188833 | 2/1957 | Fed. Rep. of Germany | 66/4 |
| 330087 | 5/1958 | Switzerland | 66/4 |
| 23509 | of 1894 | United Kingdom | 66/4 |
| 24660 | of 1895 | United Kingdom | 66/4 |
| 138289 | 2/1920 | United Kingdom | 66/4 |

*Primary Examiner*—Ronald Feldbaum
*Attorney, Agent, or Firm*—Allen J. Jaffe

[57] ABSTRACT

A manual knitting frame having a pair of support blocks at opposite ends of two or more spaced longitudinally elongated members. Pegs projecting from each of the members. Rods connecting the blocks and passing through the members, one of which is threaded such that the spacing between the members can be adjusted. According to another form, the adjustment of the members is accomplished by screws attaching the members to a support at each end thereof.

4 Claims, 28 Drawing Figures

MANUAL KNITTING APPARATUS

BACKGROUND OF THE INVENTION

In principle there are two general types of hand knitting devices. The first, and most commonly employed, is knitting needles; the other utilizes pegs placed either in a row on a linear frame or in a circle on a circular frame.

The needle-knitting is by far the more popular because the knitting needles are less expensive, easy to carry, can knit both flat and tubular forms, can perform increasing and decreasing widths. However, needle-knitting has always been a tedious process requiring a high degree of skill for production of satisfactory results. By knitting on pegs, one can always get a very uniform fabric. However, there are many difficulties associated with the frame-knitting devices characterized by the prior art. For example, each peg on such knitting frames is a loop-forming element and the pegs are arranged in a single row. Therefore, the loops on pegs are tightly attached to the pegs, so it is always difficult to manipulate the loops on the pegs. Circular frames are used to knit tubular fabrics. However, in order to knit material of different sizes, many frames of different sizes are required. Another disadvantage of the circular frame is that in its use increasing and decreasing fabric widths cannot be generated, These being basic functions for shaping. Another disadvantage of the linear frame is that the length required is at least twice the width of the fabric. Thus, one needs at least a frame two feet in length to knit fabric of a one foot width. Other hand knitting devices are known, but they are either not practical or too complicated.

SUMMARY OF THE INVENTION

An object of this invention is to provide a hand knitting device which is easy and convenient to use and which produces knitted goods of excellent quality.

Another object of this invention is to provide an improved knitting frame having adjustable and removable parts permitting the selection of various sizes and patterns in making knitted goods.

Another object of this invention is to provide an improved knitting frame in which the pegs are arranged in zigzag, some of the pegs are used for supporting the yarn and loops.

Another object of this invention is to provide an improved knitting frame such that in use, there are enough working spaces between the yarn and the pegs.

Another object of this invention is to provide methods of knitting yarn which are rapid and which require minimum skill and effort.

Another object of this invention is to provide a method to knit both tubular and flat goods on the same knitting frame.

Another object of this invention is to provide a method for making double knitted goods.

Another object of this invention is to provide a method for making interlocking knitted goods.

Another object of this invention is to provide a method for making warp knitted goods.

BRIEF DESCRIPTION OF THE DRAWINGS

For a fuller understanding of the present invention, reference should now be had to the following detailed description thereof taken in conjunction with the accompanying drawings, wherein.

DESCRIPTION OF THE PREFERRED EMBODIMENTS

Figure 1:
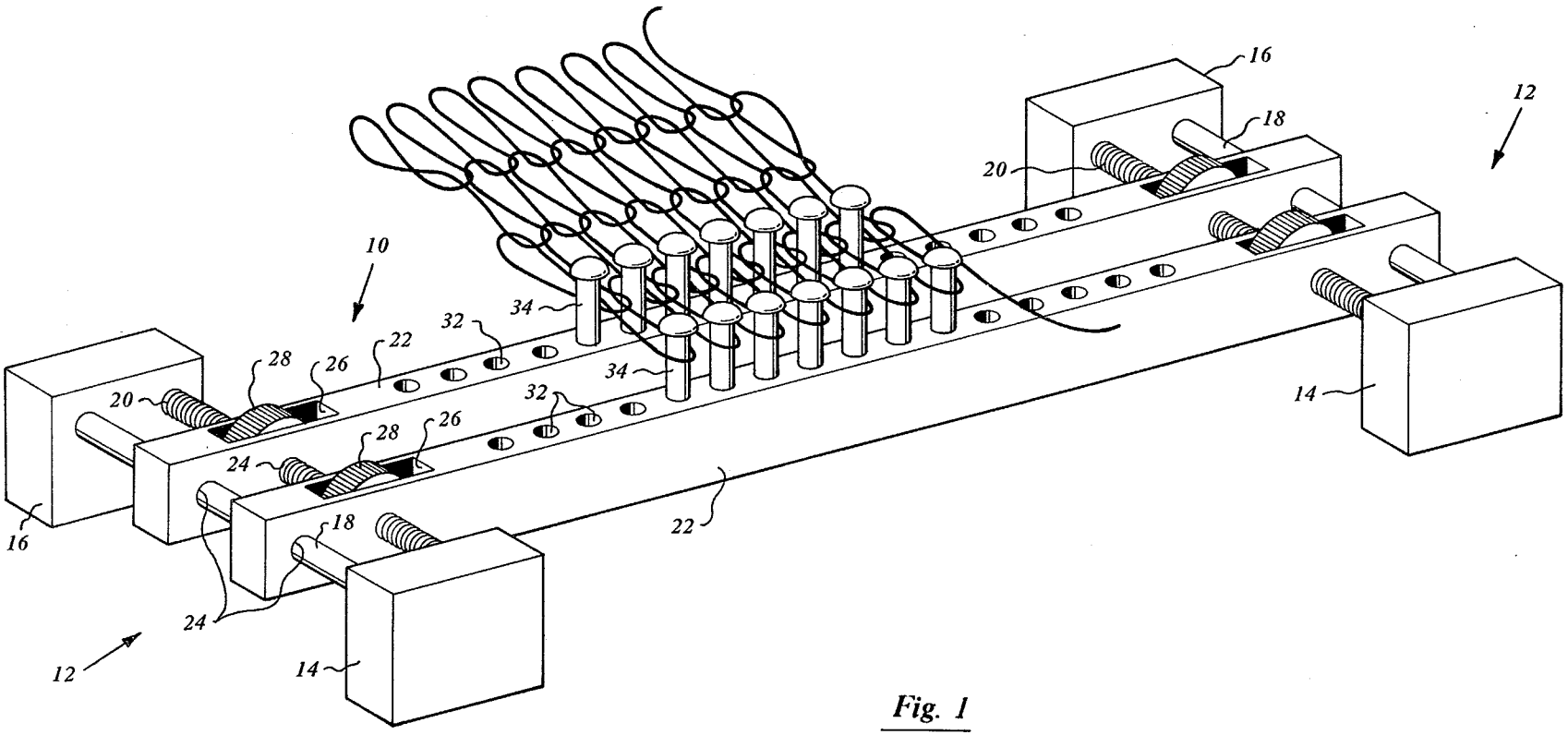
FIG. 1 is a pictorial view of a knitting frame embodying the invention and showing flat fabric being knitted.

Referring now to the drawings and, more particularly, to FIG. 1, the basic knitting frame of the present invention is depicted generally by the numeral 10 and comprises a pair of opposed base sections 12. Each base section comprises a pair of generally rectangular blocks 14, 16 which serve as end supports for a pair of transverse members or rods 18, 20 suitably removably fitted into blocks 14 and 16 to form a rigid assembly. Inner rods 20 are preferably threaded for a purpose to become apparent hereinbelow.

Completing the basic frame structure are a plurality of elongated cross bars 22, only two of which are illustrated in FIG. 1. Bars, 22 have at each end thereof a pair of through openings 24 for sliding engagement with each of the transverse rods 18, 20. A generally rectangular opening or slot 26 is located at each end of bars 22 for the reception of an adjusting wheel or knob 28 that has an internally threaded central opening (not shown) for cooperation with each of the threaded rods 20 for accurately spacing the bars 22. For this purpose outer rods 18 may have suitable indicia thereon in the form of a distance scale.

On the upper surface of bars 22 are located a plurality equi-spaced holes 32 which may be threaded for the insertion of a plurality of pegs 34. The pegs may be of the type shown in FIG. 3 having enlarged rounded heads 36 to prevent slippage of the yarn off the pegs and yet permit easy slippage along the shaft 38 thereof. The pegs may be of different colors to facilitate the knitting of various pattern designs; and the size of the blocks 14, 16 are such to permit sufficient space between the bottom of the bars 22 and a table top such that the knitted fabric can easily pass through. As illustrated in FIG. 1 the use of two bars 22 facilitates knitting a flat fabric whereas the use of four bars in FIG. 2 facilitates the knitting a tubular fabric, as will be apparent by the specific examples hereinbelow.

In the operation of the thus far described apparatus, after the number of bars are chosen for the type of knitting desired. The bars 22 are spaced along rods 18 and 20 by rotating knobs 28 to set the proper distance, depending upon the size of the yarn and the desired effect. Similarly dependent are the number and arrangement of pegs 34 that are inserted, as by screwing or press-fitting, into holes 32. In general, larger distances between the pegs on each bar produces larger loops in the knitted fabric. The pegs may be arranged in zigzag fashion or in pairs.

Figure 6:
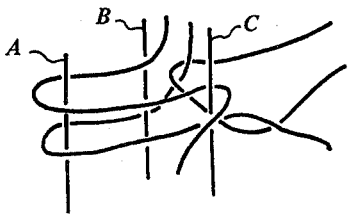
FIGS. 6 through 13 illustrate schematically the manner in which knitting is accomplished.
Figure 10:
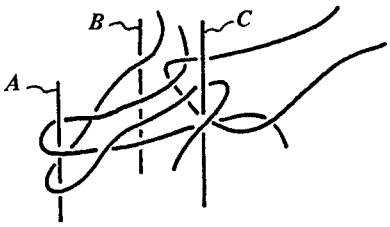
Figure 7:
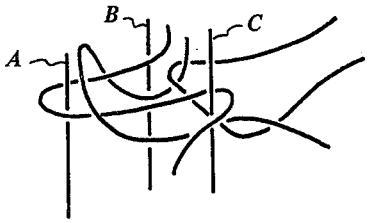
Figure 11:
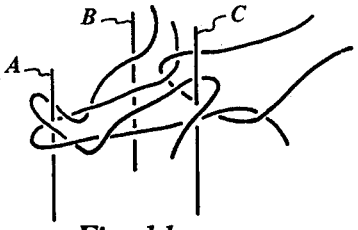
Figure 8:
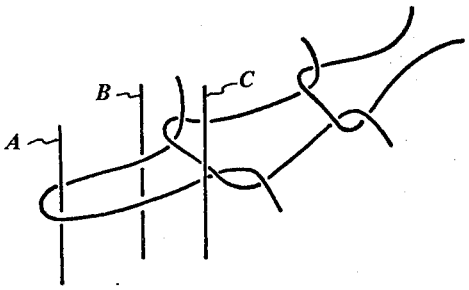
Figure 12:
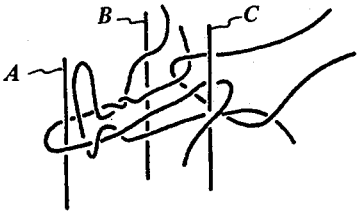
Figure 9:
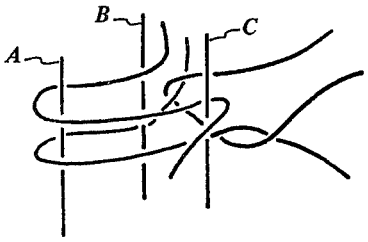
Figure 13:
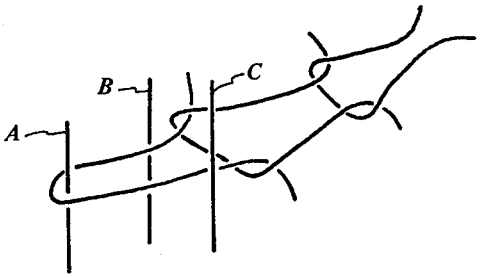

Examples of the types of stitches that can be knit are shown in FIGS. 6 through 13 with FIGS. 6 through 8 illustrating the "knit" in needle-knitting and FIGS. 9 through 13 illustrating the "purl" stitch in needle knitting.

In the use of the apparatus, thus far described to knit fabrics, the selection of holes 32 for pegs 34 and the distance between bars 22 depends on the size of yarn and the desired effect. In general, a larger distance between the pegs and the bars will provide larger loops in the knitted fabric. The pegs may be arranged in zigzag fashion or in opposite pairs. The back of the fabric is always worked on. By using a hook or similar well-known implement there are two ways to knit a loop on the peg as shown in FIGS. 6 through 13 wherein each row of pegs 34 on separate bars 22 are depicted schematically by A,B and C respectively. There are no loops on pegs B and C which are used to support yarn; peg A containing the loop. FIGS. 6 through 8 show the knitting of a stitch which is the same as the "knit" stitch in needle-knitting. FIGS. 9 through 15 show the knitting of a stitch which is the same as the "purl" stitch in needle-knitting.

Figure 14:
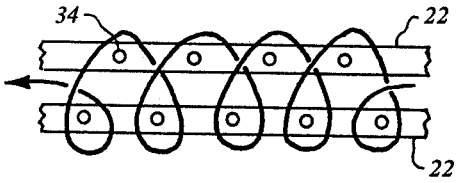
FIGS. 14 through 28 schematically illustrate various techniques for knitting different types of fabric.
Figure 15:
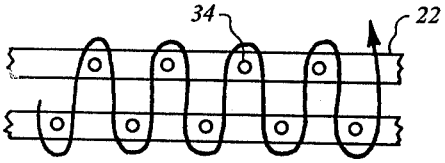

In the use of the apparatus to knit flat knitted fabric, two bars 22 are used; pegs 34 are arranged in two rows in zigzag fashion as shown in FIGS. 1, 14 and 15. The pegs in the first row (counting from the operator) form loops. There are no loops on the pegs in the second row during the knitting. The yarn is cast on the pegs as shown in FIG. 14 by alternatively making loops on the pegs in the first row and drawing yarn around the pegs in the second row in zigzag fashion. The yarn is then drawn continuously around all pegs in zigzag fashion as in FIG. 15 and all loops on each peg in the first row is knitted. By repeating this process a flat knitted fabric is formed at the back of the second bar.

Figure 2:
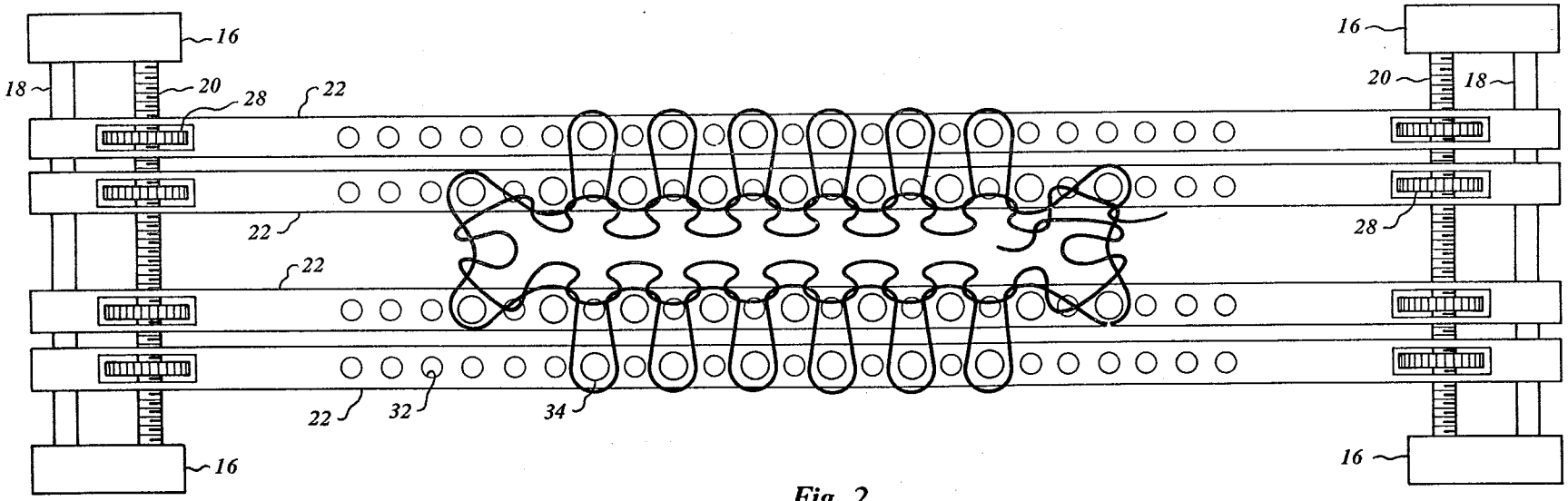
FIG. 2 is a top plan view of the knitting frame of FIG. 1 modified for use in knitting a tubular fabric.
Figure 3:
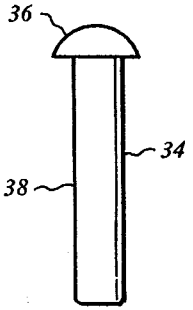
FIG. 3 illustrates a peg that is used in the frame of FIG. 1.
Figure 16:
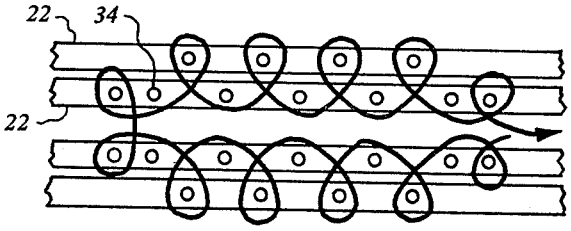
Figure 17:
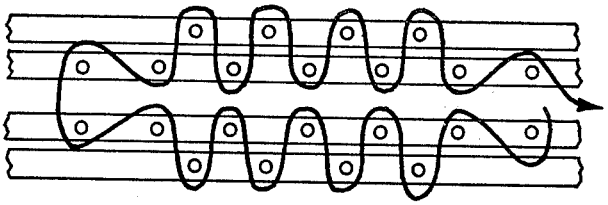

In the use of this invention to knit tubular fabric, four bars are used as illustrated in FIG. 2, the pegs 34 are arranged in four rows as shown in FIGS. 2, 16 and 17. The pegs in the second and third rows, except four end pegs, are inside pegs which do not form loops during the knitting. All other pegs are outside pegs which form loops. Yarn is cast on pegs as shown in FIG. 16 by alternately making a loop on each outside peg and drawing yarn around each inside peg. Then yarn is drawn around each peg in zigzag fashion as shown in FIG. 17 and each loop is knitted on the outside pegs. By repeating this process, a tubular fabric is formed in the middle which can be drawn from below the bars 22.

Figure 18:
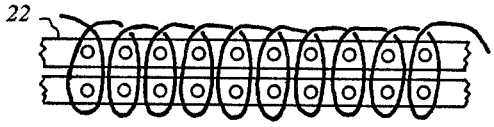
Figure 19:
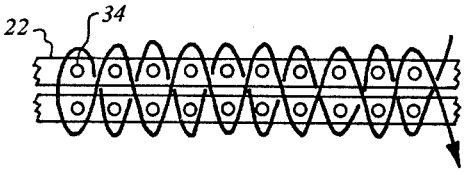
Figure 20:
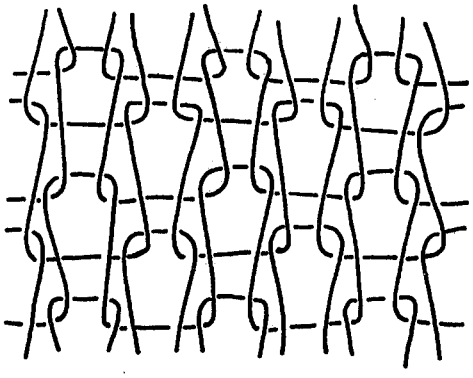

In the use of this invention to knit interlocked knitted fabric, two bars are used, pegs are arranged in two rows in pairs as shown in FIG. 18. A rubber band or the like may be tied to each pair of pegs to prevent the yarn from being caught between the pegs. Each pair of pegs works as a unit, forming loops and supporting yarn. The yarn is cast on each unit as shown in FIG. 18 by making loops on each unit. Then the yarn is continuously drawn around each unit in zigzag fashion as shown in FIG. 19 and each loop is knitted on all units. By repeating this process an interlocked knitted fabric is generated as shown in FIG. 20.

Figure 21:
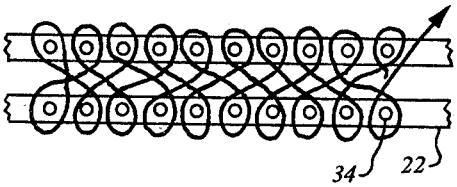
Figure 22:
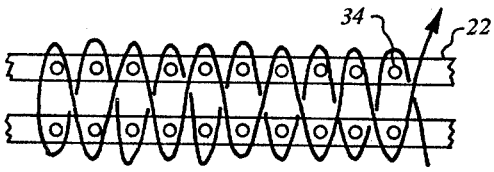

In the use of this invention to knit double-knitted fabric, two bars are used and the pegs 22 are arranged in two rows in pairs. All pegs form loops. The yarn is cast on each peg as shown in FIG. 21. Then the yarn is continuously drawn around each peg in zigzag fashion as shown in FIG. 22 and each loop is knitted on all the pegs. By repeating this process a double-knitted fabric is formed between the bars. Both sides of the fabric are the same and an interlocked knitted fabric is formed. This method is particularly useful for knitting scarfs.

Figure 23:
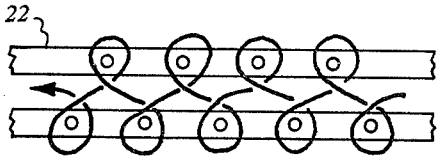
Figure 24:
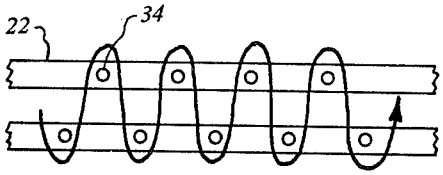

This present invention can also be employed to knit simple rib knitted fabric, by using two bars. Pegs are arranged in two rows in zigzag fashion as shown in FIG. 23. All pegs form loops. The yarn is cast on pegs by making loops in each peg in zigzag fashion as shown in FIG. 23. Then the yarn is continuously drawn around each peg as shown in FIG. 24 and each loop is knitted for all pegs. By repeating this process, a simple rib knitted fabric is formed between the bars. This method can also be modified to make rib knitted fabric of other ratios. All of the above cast-on methods can also be modified to get a tighter binding.

Figure 25:
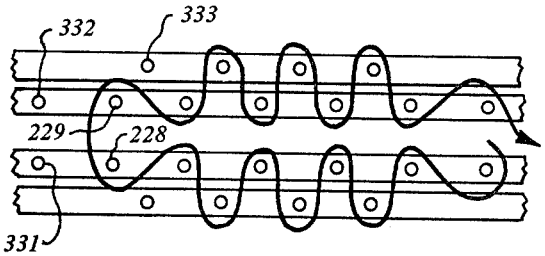

Increasing and decreasing are very similar in all types of knitting. Next, for illustrative purposes, it is shown how to do increasing and decreasing in knitting tubular goods. Referring to FIG. 25, an increasing of two stitches can be obtained by the following process.

Draw yarn around each peg and knit the loops on the outside pegs, except, for pegs 28 and 29. Next, draw yarn around each peg and knit all loops on outside pegs, except pegs 228 and 229. There are two loops on peg 228 and peg 229, respectively. Only the bottom loops are knitted so there are still two loops on peg 228 and 229, respectively. Then add pegs 230, 231, 232 and 233 as shown in FIG. 30. Draw yarn and knit on loops in clockwise direction until peg 228. Bring yarn to peg 228, knit the top loop and bring the new loop on peg 228 to peg 230. Then bring yarn to peg 228 again, knit the loop on peg 228 and bring the new loop on peg 228 to peg 231. Do the same for the loops on peg 229. Then draw yarn around each remaining pegs and knit the loops on the outside pegs until returning to the starting peg.

Figure 26:
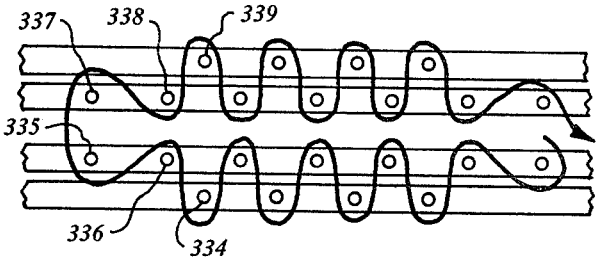

Referring to FIG. 26, a decreasing of two stitches can be obtained by the following process.

Draw yarn around and knit the loops in a clockwise direction until peg 334. Draw yarn to peg 334 and knit the loop on peg 334 then bring the remaining loop to peg 336. Take away pegs 334 and 335. Do the same for pegs 337, 338 and 339. Then draw yarn around and knit the loops until returning to the starting peg.

Figure 27:
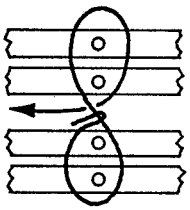
Figure 28:
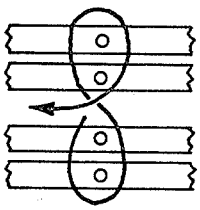

The use of this present apparatus to make hair bands or similar goods is illustrated, in FIGS. 27 and 28. Four bars and four pegs are used. Pegs are arranged in a column, pegs in the first and second bars form a unit, whereas pegs in the third and fourth bars form another unit. Cast yarn on the unit as shown in FIG. 27 by making loops on each unit. Draw yarn around each unit as shown in FIG. 28, then knit on the loops. By repeating this process, a single color hair band knitted.

There are many variations to the above all types of knitting methods. For example, two loops can be cast on each loop-forming peg, then knit only the bottom loops, keeping two loops on each loop-forming peg. In this way, one can get thicker fabric. Another example is that more than one color can be used to make pattern designs.

Figure 4:
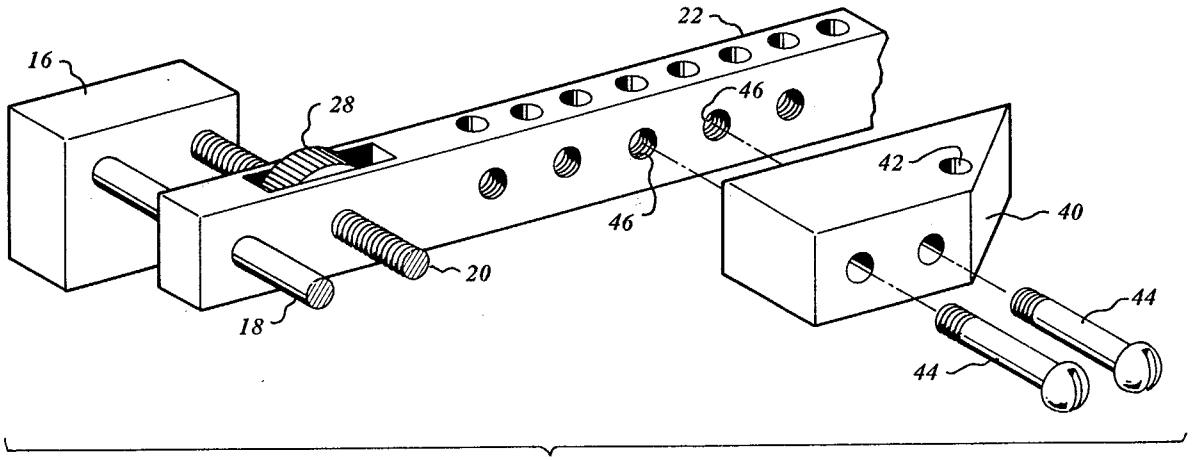
FIG. 4 is a pictorial view of an auxiliary attachment.

FIG. 4 shows a block 40 with a single peg receiving hole and which can be attached to bars 2 by suitable means, such as screws 44 and threaded openings 46 in the bars 22. The purpose of attaching block 30 to bars 22 is to decrease the distance between some pegs. For example, in knitting double-knitted fabric, the decreasing distance between end pegs improves the binding.

Figure 5:
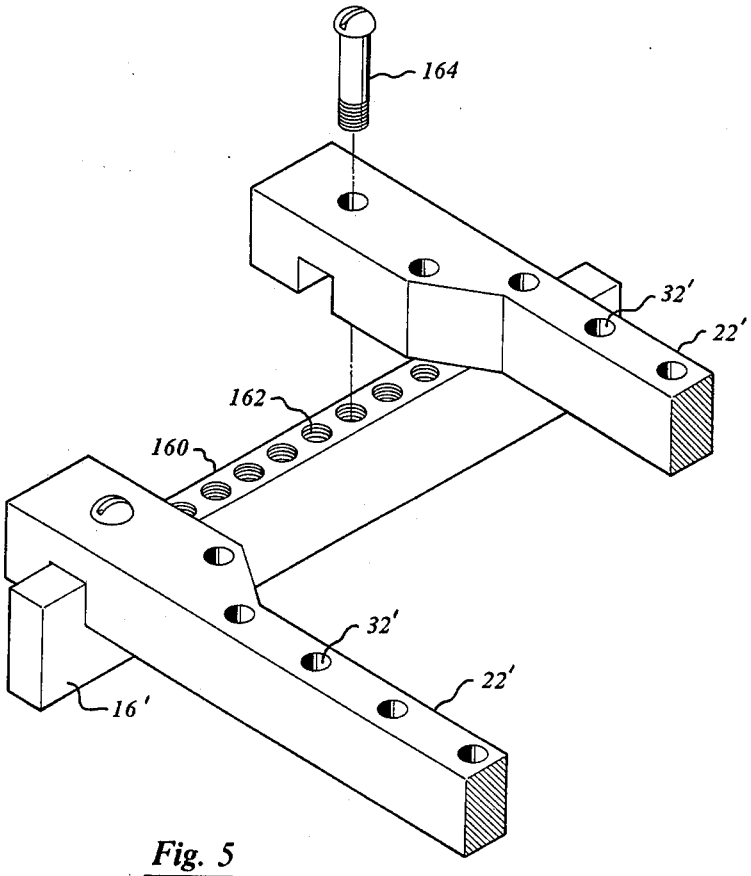
FIG. 5 is a pictorial view of a simplified frame.

An alternate embodiment of the limiting frame of FIG. 1 is shown in FIG. 5. This embodiment, particularly suited for the knitting of a flat fabric, comprises a pair of base members 22' (only one of which is shown)

each in the form of an elongated rectangular block, the upper surface 160 of which has a plurality of transversely extended threaded openings 162 to which longitudinal knitting bars 22' may be adjustably secured by means of screws 164. As in the previous embodiment holes 32' are provided for removable pegs. To reduce costs the pegs may be permanently fixed to the bars 22'. Adjustment of the bars 22' is accomplished by securing the same into different spaced holes 162 in base 16'. The operation of this form of manual knitting apparatus is similar to that previously described with respect to the FIG. 1 embodiment.

Although preferred embodiments of the present invention have been disclosed, changes will obviously occur to those skilled in the art without departing from the spirit thereof. It is therefore intended that the present invention be limited only by the scope of the appended ciaims.

I claim:

1. A manual knitting frame, comprising;

(a) two pairs of longitudinal extending elongated substantially rectangular members in spaced parallel relation to one another, (b) each of said members having planar upper surfaces containing a plurality openings therein, (c) a plurality of knitting pegs removably inserted in a predetermined member of said openings depending upon the type and shape of fabric to be knitted, (d) each of said members having planar side faces perpendicular to said upper surfaces, (e) a pair of through openings in each of said side faces at opposite ends of said members, (f) a pair of transverse rods passing through said through openings at each end of said members with the innermost rod of each pair having exterior threads, (g) rectangular openings in each of said upper surfaces at opposite ends of each of said members, (h) circular adjusting knobs in each of said rectangular openings having a central internally threaded opening in mating engagement with respective ones of said innermost externally threaded transverse rods, (i) a pair of substantially rectangular support blocks at opposite ends of said members each having planar side faces, and (j) said transverse rods being supported by said side faces at a location thereon so oriented to support said members with enough clearance from a work surface such that knitted fabric passes easily therethrough without bunching up.

2. The knitting frame according to claim 1, wherein;

(k) said pegs are of multi-colors to facilitate knitting of various patterns and designs.

3. The knitting frame according to claim 2, further comprising;

(l) additional openings in the side faces of said members, and (m) one or more blocks removably attached to selected ones of said additional openings having an upper surface coplanar with said member upper surfaces and having a peg containing opening in said upper surface to thereby improve the binding of the knitted fabric.

4. The knitting frame according to claim 1, further comprising;

(k) additional openings in the side faces of said members, and (l) one or more blocks removably attached to selected ones of said additional openings having an upper surface coplanar with said member upper surfaces and having a peg containing opening in said upper surface to thereby improve the binding of the knitted fabric.

* * * * *